US006094142A

United States Patent [19]

Lu

[11] Patent Number: 6,094,142

[45] Date of Patent: Jul. 25, 2000

[54] SPIN-ON GLASS DISPENSING MONITOR

[75] Inventor: Chung-Chien Lu, Hsinchu, Taiwan

[73] Assignee: United Microelectronics Corp., Hsinchu, Taiwan

[21] Appl. No.: 09/111,166

[22] Filed: Jul. 7, 1998

[30] Foreign Application Priority Data

May 16, 1998 [TW] Taiwan ..... 87207633

[51] Int. Cl.[7] ..... G08B 21/00

[52] U.S. Cl. ..... 340/626; 340/679; 364/528.18; 222/55; 222/61; 222/379; 702/138

[58] Field of Search ..... 340/626, 679; 364/528.1, 528.17, 528.18; 118/679, 684; 222/4, 20, 39, 55, 57, 61, 399, 397, 402.11; 702/50, 138

[56] References Cited

U.S. PATENT DOCUMENTS 4,972,180 11/1990 Akai et al. ..... 340/626

5,808,559 9/1998 Buckler ..... 340/626

5,905,656 5/1999 Wang et al. ..... 364/525.18

*Primary Examiner*—Daniel J. Wu

*Attorney, Agent, or Firm*—Knobbe, Martens, Olson & Bear LLP

[57] ABSTRACT

A dispensing monitor used in a SOG machine to planarize a semiconductor substrate which includes: a container, a gas control valve. a gas release valve, a pressure monitor, and a pressure sensing apparatus. A chemical solution contained in the container is controlled and conveyed through the gas control valve to be sprayed onto the substrate. The pressure monitor and the pressure sensing apparatus and the gas release valve are used for monitoring the internal pressure to keep a constant pressure so that the chemical solution is precisely exported.

10 Claims, 2 Drawing Sheets

SPIN-ON GLASS DISPENSING MONITOR

CROSS-REFERENCE TO RELATED APPLICATION

This application claims the priority benefit of Taiwan application serial no. 87207633, filed May 16, 1998, the full disclosure of which is incorporated herein by reference.

BACKGROUND OF THE INVENTION

1. Field of the Invention

This invention relates to an apparatus with constant liquid spray rate, and more particularly to a dispensing monitor to maintain a constant liquid spray rate by controlling the pressure of the gas used to drive the liquid.

2. Description of Related Art

A silicon substrate used in semiconductor fabrication usually has an uneven surface, the result of the number of dielectric layers formed over the substrate to cover some structure such as a contact window or a capacitor. Semiconductor fabrication therefore needs a planarization process to obtain an even substrate surface. Otherwise, becau0 se of the differences in relative elevation, the interconnecting metal lines can not easily be formed and the precision of transferring a desired pattern onto the substrate is compromised.

Currently, a technology of spin-on glass (SOG) is widely used for a local planarization on the substrate surface. SOG uses a solution that includes a dielectric material in a solvent for spin coating on the substrate. The dielectric material in the solution fills the concave structures on the substrate to obtain a local planarization.

The spray rate of the SOG solution is usually quite so low that a special apparatus is necessary to precisely control the spray rate. FIG. 1 is a schematic setup of a conventional Tokyo Okika Kggyo CO.LTD (TOK) SOG machine. In FIG. 1, there is a container 2, which contains a SOG solution and a gas. A special cover 4 covers the container 2. Helium (He) gas is pumped into the container 2 through a duct 40 and the cover 4 in order to pressurize container 2, which propels the SOG solution out through the cover 4 and a duct 42. There is a valve 6 on the duct 42 to control whether the SOG solution is exported or not. When the valve 6 is open, SOG solution is driven to a nozzle 8, located at the terminal end of the duct 42. The nozzle 8 sprays SOG solution onto a semiconductor substrate 44 for planarization on the substrate surface. Moreover, in general, in order to measure and control the internal pressure, a pressure sensing apparatus 11 close to a pressure switch 10 is mounted on the duct 40 to indirectly measure the internal pressure of container 2. In this case, if there is any damage to the duct 42, the damage cannot be detected with the result that the spray rate cannot be precisely controlled. This is a serious drawback of the TOK SOG machine.

FIG. 2 is a schematic setup of a conventional Dai Nipon Screen CO.LTD (DNS) SOG machine. The like reference numbers represent the like objects. The DNS SOG machine is similar to the TOK SOG machine except for the container 2. In FIG. 2, a container 22 contains a SOG solution and is located inside a pressure barrel 12. The container 22 is compressible and can be compressed by the pressure barrel 12 to propel the SOG solution out through the cover 4 and the duct 42. The pressure barrel 12 is pressurized when $N_2$ is supplied along the duct 40. Since the pressure sensing apparatus 11 is in the same location as in the TOK SOG machine, both SOG machines have the same problem as described above in TOK machine.

SUMMARY OF THE INVENTION

It is therefore an objective of the present invention to provide a dispensing monitor utilizing a pressure sensing apparatus mounted on an output duct of a pressure container which contains a pressurized SOG solution used to push the SOG solution through the output duct. The pressure sensing apparatus is connected to a pressure monitor. The internal pressure can be directly measured and therefore damage to the duct can be directly monitored. A warning is issued by the pressure monitor if damage has been detected.

In accordance with the foregoing and other objectives of the present invention, a dispensing monitor used in a SOG machine on a semiconductor substrate includes: a gas release valve, a pressure monitor, and a pressure sensing apparatus. The SOG machine also includes a container and a gas control valve. The container contains chemical solution and is filled with gas. The chemical solution is pressurized by the gas and then is exported through the gas control valve to the spraying end of the output duct and then sprayed onto the substrate. The gas release valve is for adjusting the internal pressure. The pressure monitor monitors the internal pressure. The pressure sensing apparatus, which is connected to the container, the gas control valve, the gas releasing valve, and the pressure monitor, is used to receive the chemical solution, export the chemical solution and send a pressure monitoring signal to the pressure monitor. The pressure monitor analyzes the pressure monitoring signal to determine whether there is any damage.

BRIEF DESCRIPTION OF DRAWINGS

The invention can be more fully understood by reading the following detailed description of the preferred embodiments, with reference made to the accompanying drawings as follows.

DETAILED DESCRIPTION OF PREFERRED EMBODIMENTS

EXAMPLE 1

Figure 1:
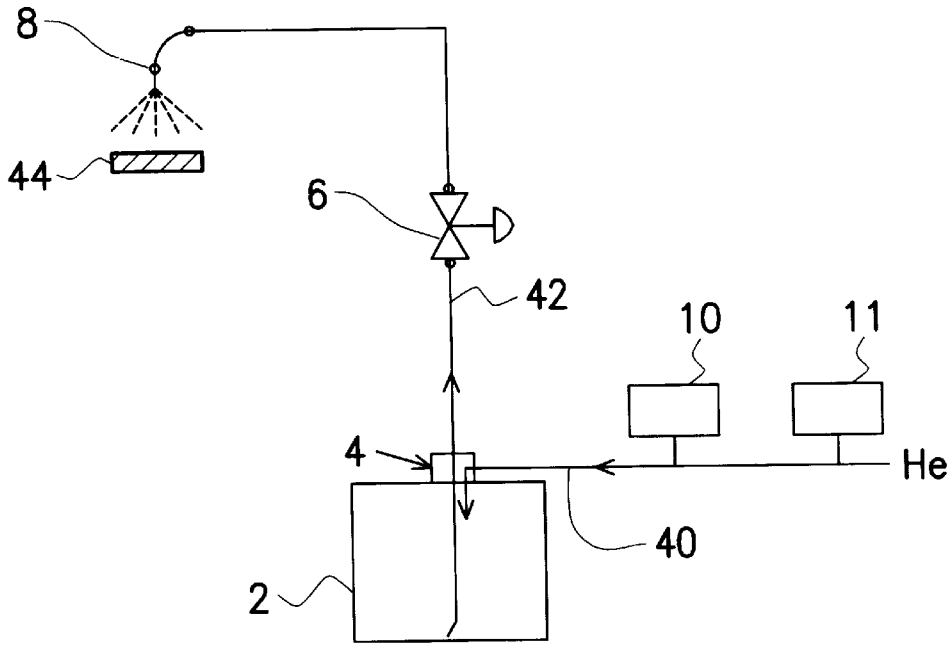
FIG. 1 (PRIOR ART)
FIG. 1 is a schematic setup of a conventional TOK SOG machine.
Figure 2:
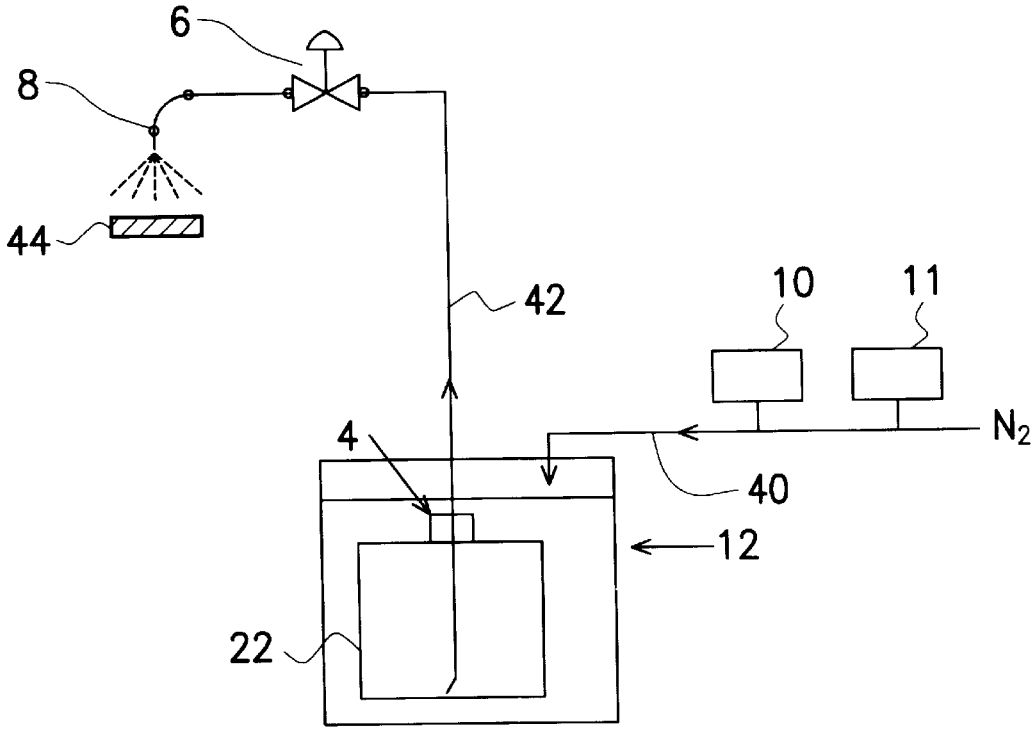
FIG. 2 (PRIOR ART)
FIG. 2 is a schematic setup of a conventional DNS SOG machine.
Figure 3:
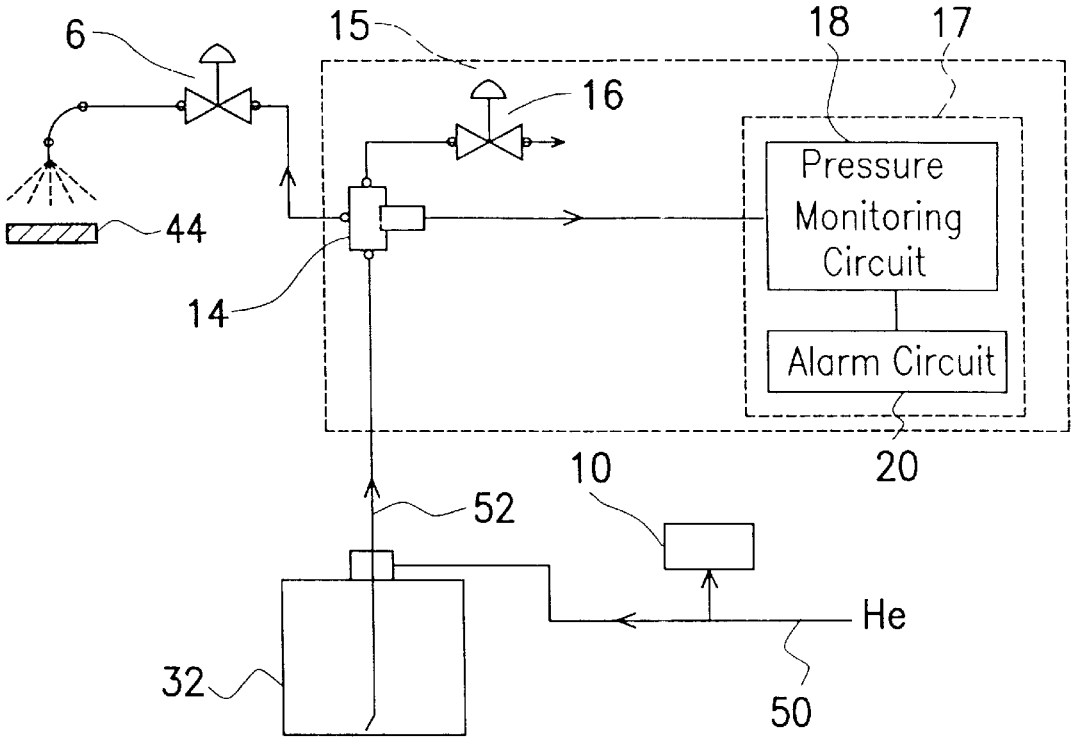
FIG. 3 is a schematic setup of a SOG machine including a SOD dispensing monitor, according to a first preferred embodiment of the invention.

FIG. 3 is a schematic setup of a SOG machine including a SOD dispensing monitor, according to a first preferred embodiment of the invention. This first preferred embodiment is intended to improve on the TOK SOG machine. The like reference numbers represent the like objects.

In FIG. 3, a dispensing monitor 15 includes a pressure sensing apparatus 14, a gas release valve 16, and a pressure monitor 17, in which the pressure monitor 17 further includes a pressure monitoring circuit 18 and an alarm circuit 20. The pressure sensing apparatus 14 is connected to a container 32, a gas control valve 6, the gas release valve 16, and a pressure monitor 17. The container contains chemical such as a SOG solution with low viscosity, and is filled with a gas such as He. Helium gas is pumped into the container 32 through a duct 50 controlled by a pressure switch 10 thus pressurizing container 32 so as to propel the SOG solution out through an output duct 52 to the pressure sensing apparatus 14.

As the pressure sensing apparatus 14 receives the SOG solution from the container 32, it sends a pressure monitoring signal to the pressure monitor 17. At the same time, the SOG solution is conveyed to the gas control valve 6. The gas release valve 16 is used to release the extra accumulated gas to maintain constant pressure. If the extra accumulated gas is not properly released, the precision of the pressure sensing apparatus can be biased, the SOG solution can deteriorate due to a reaction between the gas and the SOG solution, or an undesired crystal can appear. Any these problems could affect the quality of the planarization.

If the internal pressure is abnormal, for any reason, such as the duct being broken or damaged, the pressure sensing apparatus 14 sends a pressure monitoring signal to the pressure monitoring circuit 18. The pressure monitoring circuit 18 analyzes the pressure monitoring signal and triggers the alarm circuit 20 to alert the operator, who can adjust or check the SOG machine.

EXAMPLE 2

Figure 4:
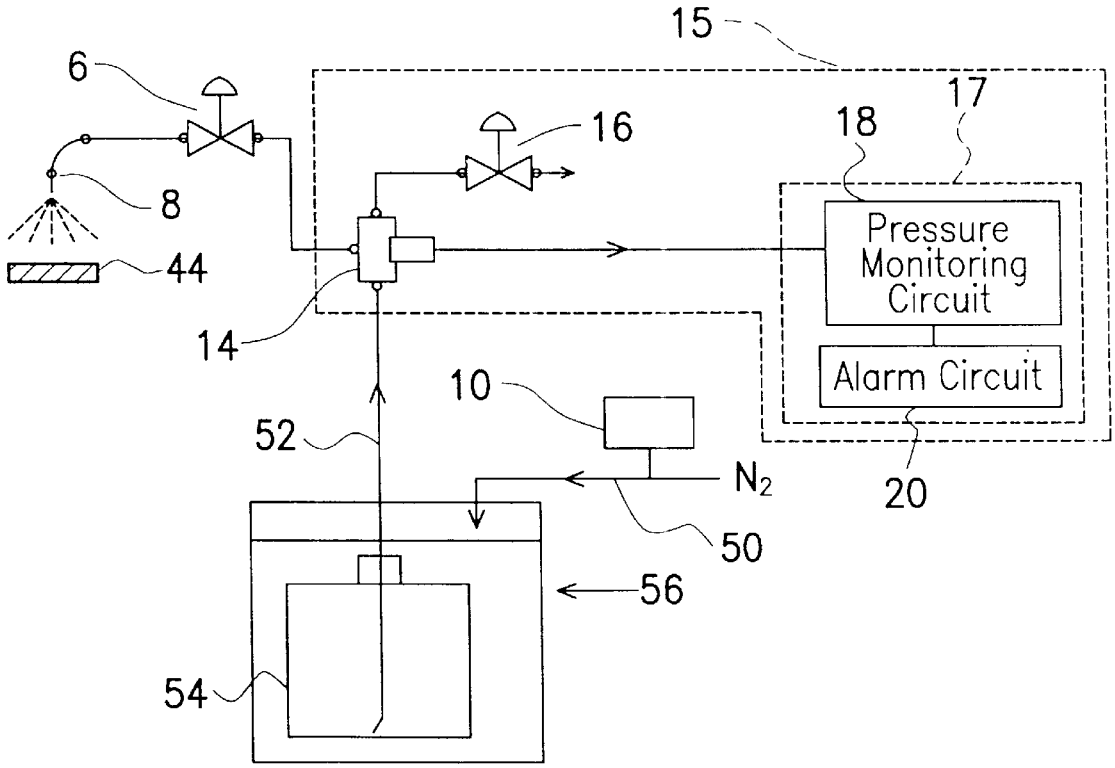
FIG. 4 is a schematic setup of a SOG machine including a SOD dispensing monitor, according to a second preferred embodiment of the invention.

FIG. 4 is a schematic setup of a SOG machine including a SOD dispensing monitor, according to a second preferred embodiment of the invention. The like reference numbers represent the like objects. This second preferred embodiment is specifically designed to improve the DNS SOG machine.

The second preferred embodiment is similar to the first preferred embodiment except regarding the containers and the gas. In FIG. 4, a container 54 contains a SOG solution and is located inside a pressure barrel 56. The container 54 is compressible and can be compressed by the pressure barrel 56 to propel the SOG solution out through the output duct 52. The pressure barrel 56 is pressurized by $N_2$ gas, supplied along the duct 50. The dispensing monitor 15 related to the invention is the same as in the first embodiment in FIG. 3 and is not repeated here.

In conclusion, the invention uses the dispensing monitor 15 on the output duct 52. The dispensing monitor 15 continually monitors the internal pressure through the pressure sensing apparatus 14. In addition, the dispensing monitor 15, through the pressure monitor 17, which includes the pressure monitoring circuit 18 and the alarm circuit 20, signals the operator to check or adjust the machine. Furthermore, the gas release valve 16 is used to release the extra accumulated gas to maintain the performance quality of the planarization.

The invention has been described using an exemplary preferred embodiment. However, it is to be understood that the scope of the invention is not limited to the disclosed embodiment. On the contrary, it is intended to cover various modifications and similar arrangements. The scope of the claims, therefore, should be accorded the broadest interpretation so as to encompass all such modifications and similar arrangements.

What is claimed is:

1. A dispensing monitor used in a spin-on glass machine, which comprises a container for containing a chemical solution and filled with a gas, and a gas control valve for controlling a spray rate, the dispensing monitor comprising:

a gas release valve for releasing the gas to regulate another internal pressure;

a pressure monitor for monitoring the internal pressure; and a pressure sensing apparatus, which is coupled to the container, the gas control valve, the gas release valve, and the pressure monitor, wherein the pressure sensing apparatus receives the chemical solution from the container, exports the chemical solution to the gas control valve and sends a pressure monitoring signal to the pressure monitor to determine whether the internal pressure is normal or not.

2. The dispensing monitor of claim 1, wherein the chemical solution comprises a low viscous liquid.

3. The dispensing monitor of claim 1, wherein the gas comprises helium gas or $N_2$ gas.

4. The dispensing monitor of claim 1, wherein the container is pressurized with the gas to propel the chemical solution out.

5. The dispensing monitor of claim 1, wherein the pressure monitor further comprises:

a pressure monitoring circuit for receiving the pressure monitoring signal to determine whether the internal pressure is normal or not, and transmitting an error detection signal if the internal pressure is abnormal; and an alarm circuit for receiving the error detection signal from the pressure monitoring circuit and triggering an alarm.

6. A dispensing monitor used in a spin-on glass (SOG) machine, wherein the SOG machine comprises a compressible container, located inside a pressure barrel, for containing a chemical solution and a gas control valve for controlling the spray rate, the dispensing monitor comprising:

a gas release valve for releasing gas to adjust internal pressure;

a pressure monitor for monitoring the internal pressure; and a pressure sensing apparatus, which is coupled to the container, the gas control valve, the gas release valve, and the pressure monitor, wherein the pressure sensing apparatus receives the chemical solution from the container, exports the chemical solution to the gas control valve and send a pressure monitoring signal to the pressure monitor to determine whether the internal pressure is normal or not.

7. The dispensing monitor of claim 6, wherein the chemical liquid comprises a low viscous liquid.

8. The dispensing monitor of claim 6, wherein the gas comprises helium gas or $N_2$ gas.

9. The dispensing monitor of claim 6, wherein the pressure barrel is pressurized with the gas to compress the chemical solution out.

10. The dispensing monitor of claim 6, wherein the pressure monitor further comprises:

a pressure monitoring circuit for receiving the pressure monitoring signal to determine whether the internal pressure is normal or not, and transmitting an error detection signal if the internal pressure is abnormal; and an alarm circuit for receiving the abnormal signal from the pressure monitoring circuit and triggering an alarm.

* * * * *